US005836900A

United States Patent [19]

Leventhal

[11] Patent Number: 5,836,900

[45] Date of Patent: Nov. 17, 1998

[54] MASSAGING APPARATUS HAVING TRANSFORMABLE PAD

[75] Inventor: Robert D. Leventhal, Los Angeles, Calif.

[73] Assignee: JB Research, Inc., Bellflower, Calif.

[21] Appl. No.: 821,020

[22] Filed: Mar. 19, 1997

[51] Int. Cl.[6] ..... A61H 1/00; A47C 17/70; A47C 17/82; A47C 4/28

[52] U.S. Cl. ..... 601/57; 601/70; 601/49; 5/632; 5/933; 5/915; 297/284.5

[58] Field of Search ..... 601/49–51, 56–60, 601/65, 86, 90, 98, 115; 5/630, 632, 633, 731, 733, 734, 933, 915; 297/452.23, 452.29, 452.32, 452.34, 284.5

[56] References Cited

U.S. PATENT DOCUMENTS

| | | | |
|---|---|---|---|
| 2,593,319 | 4/1952 | Levitin et al. | 5/633 X |
| 2,953,793 | 9/1960 | Rossi | 5/733 X |
| 3,305,878 | 2/1967 | Hellbaum | 5/630 X |
| 4,006,739 | 2/1977 | Wahl | 601/57 |
| 4,970,742 | 11/1990 | Keener | 5/633 |
| 5,121,961 | 6/1992 | Marshall | 5/632 X |
| 5,297,848 | 3/1994 | Grinnell | 297/284.5 X |
| 5,314,235 | 5/1994 | Johnson | 297/284.5 |
| 5,357,642 | 10/1994 | Clute | 5/632 X |
| 5,437,608 | 8/1995 | Cutler | 601/49 |

*Primary Examiner*—Danton D. DeMille
*Attorney, Agent, or Firm*—Sheldon & Mak

[57] ABSTRACT

A massaging apparatus includes a foam pad having top and bottom profiles and a composite volume VC of foam; and a vibrator coupled to the foam pad for vibrating the pad. The pad is formed including a first foam phase defining the bottom profile and having a first phase volume V1 being not less than approximately 50 percent of the volume VC, and a second foam phase defining at least a portion of the top profile and having a second phase volume V2 being a pin member projecting from proximate the side surface, through the solid portion of the threaded insert, and engaging the first structural member on opposite sides of the cavity, the pin member securing the threaded insert in the cavity. A method for forming the pad includes preparing a liquidic slow-curing first foam formulation; feeding the first foam formulation into a mold; preparing a liquidic faster-curing second foam formulation; after a first period of time following the step of feeding the first foam formulation, feeding the second foam formulation into the mold onto the first formulation; curing the formulations; removing the cured foam article from the mold; forming a cavity in the article being a foam pad; and assembling a vibratory transducer into the cavity to form a vibratory massaging pad.

10 Claims, 4 Drawing Sheets

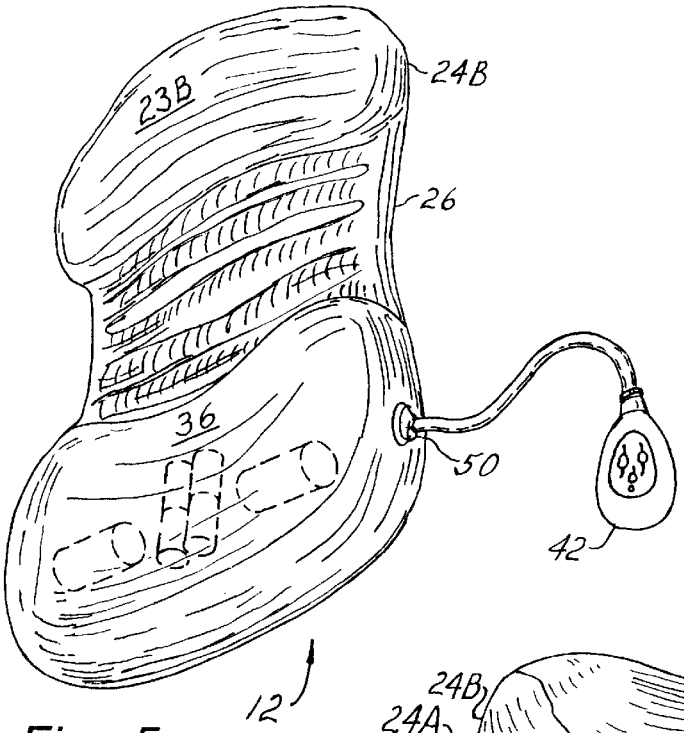
Fig. 5.
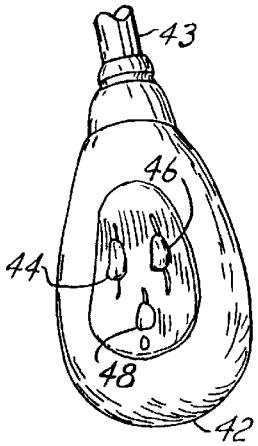
Fig. 3.
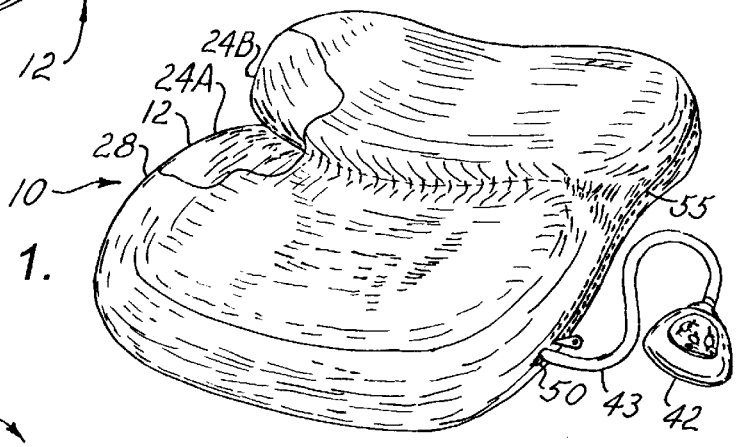
Fig. 1.
Fig. 2.
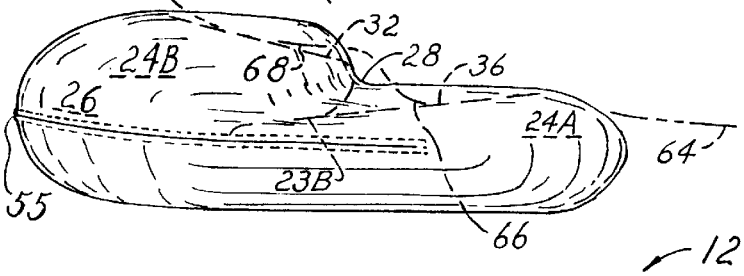
Fig. 4.
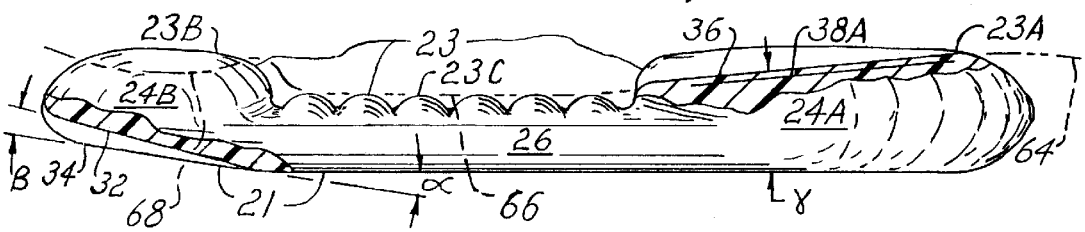

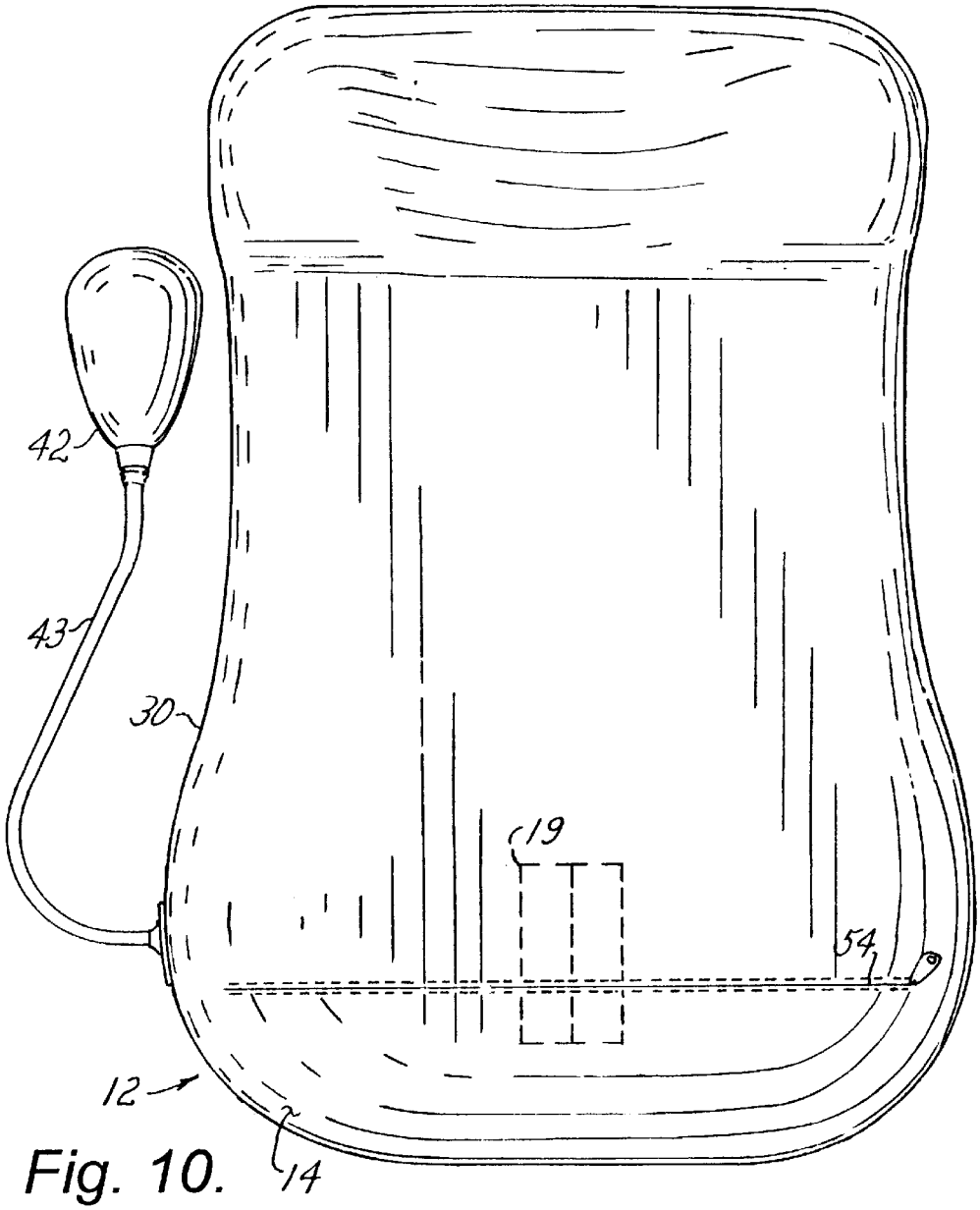
Fig. 10.
Fig. 11.
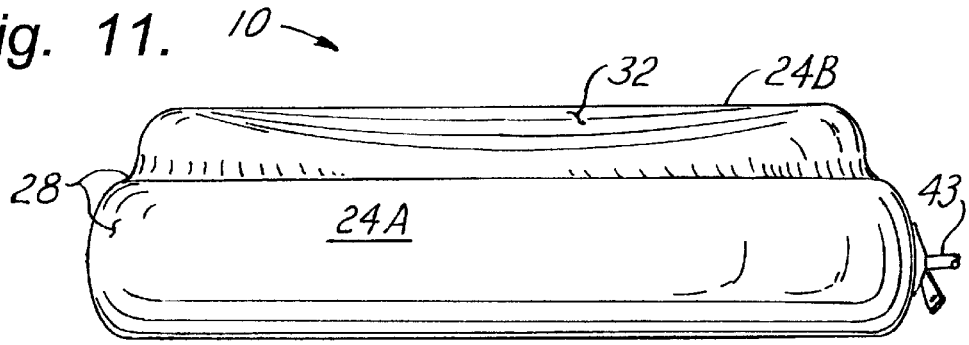

MASSAGING APPARATUS HAVING TRANSFORMABLE PAD

BACKGROUND

The present invention relates to vibratory massagers, and more particularly to massagers of the type having vibratory elements mounted in association with a body-contacting pad.

One popular form of vibratory massaging pad has one or more vibratory elements mounted within respective cavities of a foam pad. A number of such pads are provided with belts or other devices for securing to various parts of a user's body. Among the difficulties with these pads are the devices being ineffective for holding the pad properly for massaging particular body portions, and the need for fastening and unfastening the devices every time the user wishes to leave the pad behind and/or to resume the massaging. Other vibratory pads are configured as mattresses on which the user reclines and as pillows to be placed under a localized portion of the user. These pads have limited usefulness due to the space requirements of mattresses and the limited suitability of pillow-type massagers for effective treatment of certain body portions. For example, mattress configurations are generally ineffective as neck massagers, and pillow configurations are not particularly suitable for upper back massaging.

Thus there is a need for a pad massager that is effective for massaging back regions, neck regions, or both, that does not require excessive space, and that is reliable and inexpensive to produce.

SUMMARY

The present invention meets this need by providing a massager having a foam pad that is transformable from a flattened configuration suitable for back massaging, to a stepped configuration suitable for upper back and neck massaging. More particularly, in one aspect of the invention, a transformable massaging apparatus includes a foam pad having a top profile, a bottom profile; a plurality of vibrators coupled to the foam pad in at least two enlarged regions of the pad for vibrating the respective regions; the pad having a flexible region connecting the enlarged regions for permitting the pad to be deformed from a flattened condition wherein the regions are generally coplanar to a folded condition wherein a first one of the enlarged regions is substantially inverted and offset relative to a second enlarged regions; and means for holding the pad in the folded condition.

The means for holding the pad in the folded condition can be a cover member. The cover member can form a covering of the flexible foam pad, the cover member having a pocket formed therein for selectively receiving the first enlarged region when the first enlarged region is folded against the second enlarged region. The massaging apparatus can further include a covering enclosing the flexible foam pad, the flexible foam pad together with the covering being removable in the folded condition from the cover member. The means for holding the flexible pad in the folded condition can be a belt member.

The top profile can have has a depression formed therein within the second enlarged region of the flexible pad, a portion of the top profile of the first enlarged region extending at least partially into the depression in the folded condition of the flexible pad. The bottom profile can have a head depression formed therein within the first enlarged region that faces away from the second enlarged region in the folded condition of the flexible pad, the apparatus being adapted for supporting a user's shoulder region on the second enlarged region while also supporting a head or neck region of the user on the first enlarged region and in elevated relation to the shoulder region.

DRAWINGS

These and other features, aspects, and advantages of the present invention will become better understood with reference to the following description, appended claims, and accompanying drawings, where:

FIG. 1 is a right front perspective view of a transformable massaging apparatus according to the present invention;

FIG. 2 is a left side view of the massaging apparatus of FIG. 1;

FIG. 3 is a detail view of a controller portion of the massaging pad of FIG. 1;

FIG. 4 is a fragmentary sectional left side view as in FIG. 2 with a cover of the apparatus of FIG. 1 removed, a massaging pad of the apparatus having assumed a flattened condition;

FIG. 5 is a right front perspective view of the massaging pad of FIG. 4;

FIG. 10 is a back view of the massaging pad of FIG. 4;

FIG. 11 is a bottom end view of the massaging apparatus of FIG. 1;

DESCRIPTION

Figure 6:
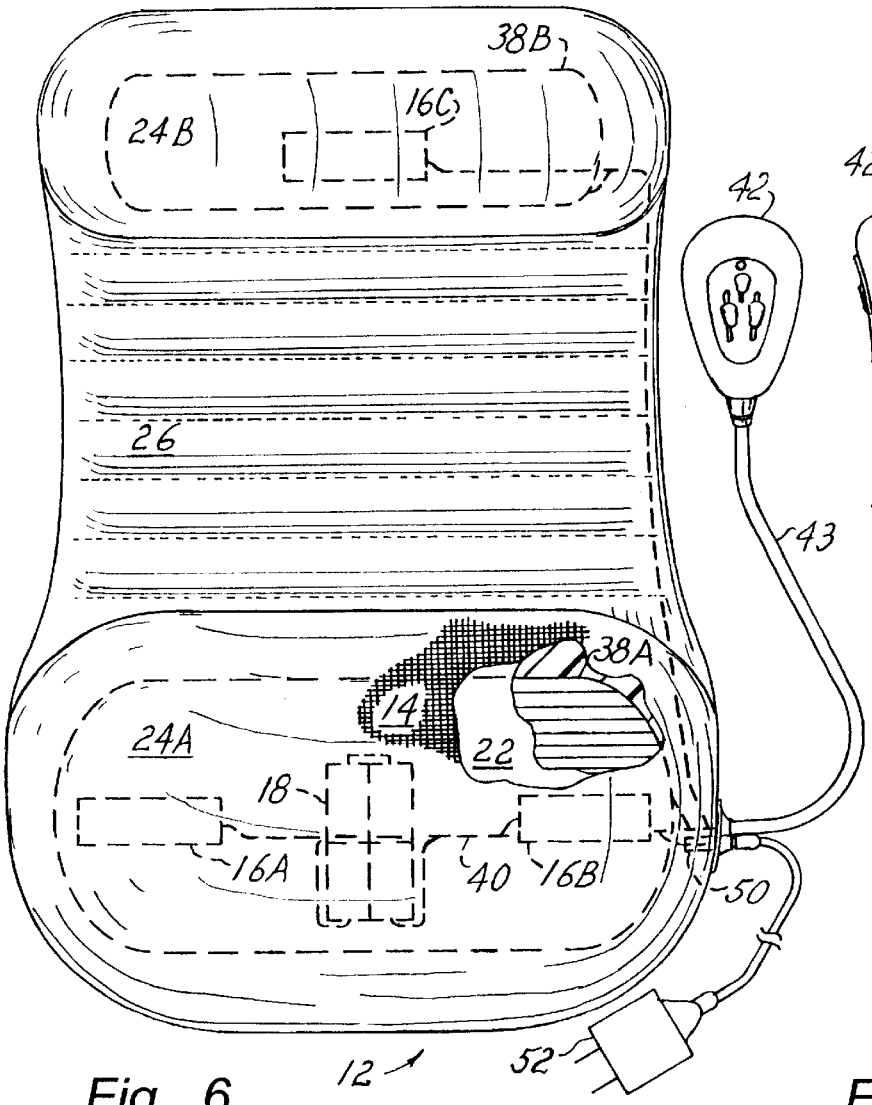
FIG. 6 is a fragmentary sectional front view of the massaging pad of FIG. 4.
Figure 7:
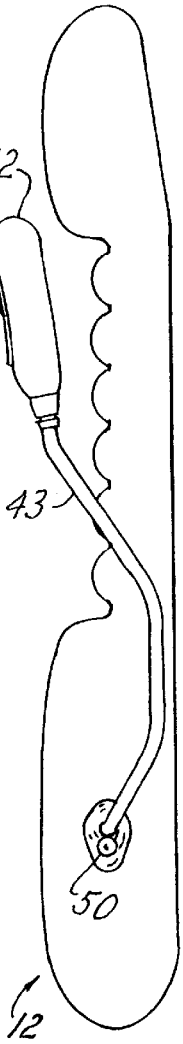
FIG. 7 is a right side view of the massaging pad of FIG. 4.
Figure 8:
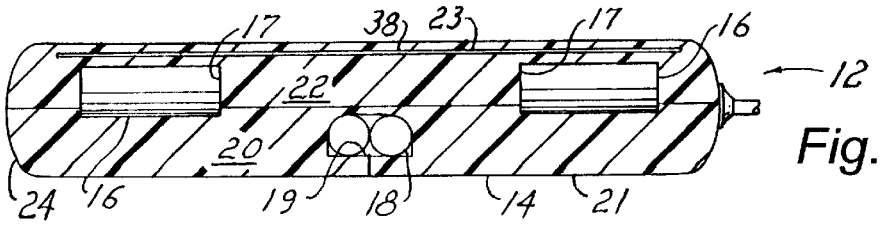
FIG. 8 is a sectional end view of the massaging pad of FIG. 4.

The present invention is directed to a massaging apparatus having a transformable pad for providing enhanced versatility and effectiveness in massaging portions of a user's body. With reference to FIGS. 1–12 of the drawings, a massaging apparatus 10 includes a foam pad 12 having a stretchable covering 14, a plurality of vibratory transducers 16 that are supported within respective cavities 17 of the pad 12. One or more batteries 18 are also provided in a counterpart of the cavities, designated 19, suitable controls for the transducers 16 being provided as described below. The pad 12 is formed of flexible foam that preferably but not necessarily includes a base layer 20 defining a lower contour 21 of the pad 12, and an upper layer 22 that defines at least a portion of an upper contour 23 of the pad 12. The base layer 20 is formed of a first material being a relatively low density flexible foam, and the upper layer 22 is formed of a second material being a foam having greater density and stiffness than the first material, the layers 20 and 22 being integrally formed in a seamless manner as described in copending application Ser. No. 08/781,751 that was filed on Jan. 10, 1997, and is incorporated herein by this reference.

According to the present invention, the vibrators 16 are coupled to the foam pad 12 in at least two enlarged regions 24 of the pad for vibrating the respective regions, designated 24A and 24B. The transducers 16 are individually designated 16A and 16B in the enlarged region 24A, and 16C in the enlarged region 24B, as indicated in FIG. 6. A more flexible region 26 of the pad 12 connects the enlarged regions 24 for permitting the pad 12 to be deformed from a flattened condition wherein the regions 24 and 26 are generally coplanar as shown in FIGS. 4–10, to a folded condition wherein one of the enlarged regions 24 is substantially inverted and offset relative to another of the enlarged regions 24 as are the regions 24A and 24B in FIGS. 1, 2, and 11. The pad 12 is retained in the folded condition by suitable means such as a removable cover 28, as also shown in FIGS. 1, 2, and 11.

In the exemplary configuration of the massaging apparatus 10 being in the flattened configuration of the pad 12 as shown in FIGS. 4–10, the lower contour 21 is substantially planar within the flexible region 26 and the enlarged region 24A, except for a convex perimeter contour 30 of the pad 12. The lower contour 21 is preferably slightly concave within a depression region 32 of the enlarged region 24B, except also for the convex perimeter contour 30 of the pad 12. Also, a side profile extremity 34 of the lower contour 21 within the enlarged region 24B is slightly inclined at an angle $\alpha$ from the substantially planar portions of the lower contour 21, as best shown in FIG. 4, the depression region 32 extending further upwardly at an angle $\beta$ relative to the side profile extremity 34. As further shown in FIG. 4, the upper contour 23 includes raised contour portions 23A and 23B corresponding to the enlarged regions 24A and 24B of the massaging pad 12, and a ribbed contour portion 23C within the flexible region 26. The ribbed configuration of the flexible region 26 advantageously enhances flexibility of the pad 12 with a lesser reduction in thickness than would otherwise be required. The raised contour portion 23A is also preferably slightly concave within a depression region 36 of the enlarged region 24A, the depression region 36 sloping slightly downwardly at an angle $\gamma$ toward the ribbed contour portion 23C. The angle $\alpha$ is preferably between approximately 3 and 10 degrees, the angle $\beta$ being between approximately 5 and 10 degrees, the total of the angles $\alpha$ and $\beta$ being preferably between 10 and 20 degrees. Also, the angle $\gamma$ is preferably between approximately 3 and 8 degrees. It will be understood that the contour portions 32 and 36 are not required to be precisely cylindrical, conical, or otherwise having simple curvature, the angular measurements being approximations of surfaces that can have compound curvature.

Figure 9:
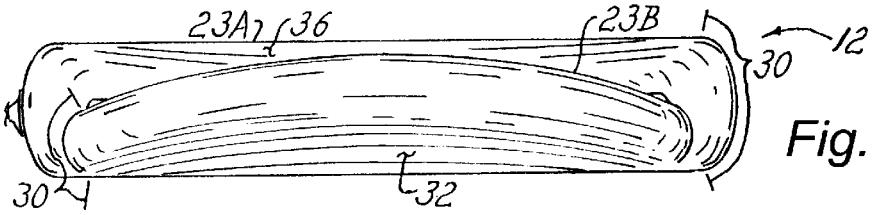
FIG. 9 is a top end view of the massaging pad of FIG. 4.

As best shown in FIG. 9, the raised contour portion 23B is preferably generally convex, being arched transversely above the perimeter contour 30, so that when the massaging pad 12 is folded into the condition of FIGS. 1, 2, and 11, the enlarged region 24B nests partially within the enlarged portion 24A as best shown in FIG. 2.

As shown in FIGS., 4, 6 and 8, the massaging pad 12 has a heating element 38, there being preferably counterparts thereof in each of the enlarged regions 24 as indicated at 38A and 38B in FIG. 6. The heating elements 38, the transducers 16, and the batteries 18 are electrically connected by a wiring harness 40 to a control unit 42 that is tethered by a cord 43 from one side of the pad 12, the control unit 42 having an intensity control 44, a mode control 46, and a heater control 48 as best shown in FIG. 3. A power socket 50 is also located within the perimeter contour of the pad 12, being connected to the harness 40 for coupling by an accessory power module 52 to an external source of electrical power for the heater elements 38. The power module 52 reduces ordinary AC utility power to a low voltage such as 6, 9, 12, or 24 volts AC or DC as appropriate for use with the heating elements 38 and the heater control 48. For example, when the heater control 48 is a simple switch, AC heater power is more appropriate for extended life of switch contacts; with bipolar transistor control elements, DC heater power is more appropriate as permitting simplified circuitry. The power module 52 in the above-described configuration of the massaging apparatus 10 can be disconnected when use of the heating elements 38 is not desired.

As shown in FIG. 9, the covering 14 has a zipper opening 54 for accessing the battery cavity 19. A suitable material for the covering 14 is a stretchable fabric such as knitted nylon. As shown in FIGS. 1 and 2, the cover 28 also has a zipper opening, designated 55, through which the massaging pad 12 is inserted in the folded condition, tension of the cover 28 maintaining the folded condition.

Figure 12:
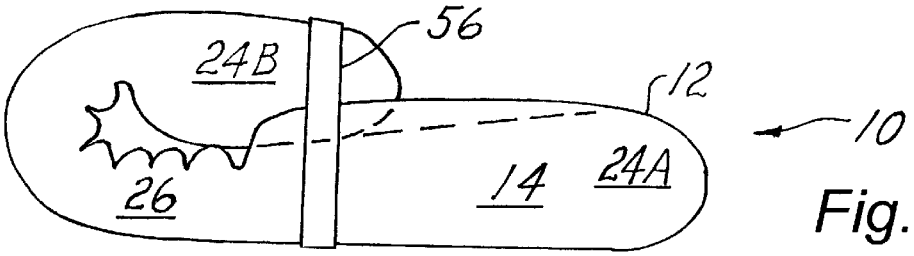
FIG. 12 is a side view as in FIG. 2, showing an alternative configuration of the massaging apparatus of FIG. 1.

With further reference to FIG. 12, an alternative implementation of the means for holding the massaging pad 12 in the folded condition is a belt member 56. The belt member 56 can be formed of a suitable stretchable material, such as an elastic band, which band can be either separate from or fastened to the covering 14 at locations wherein the band 56 extends under the lower contour 21.

Figure 13:
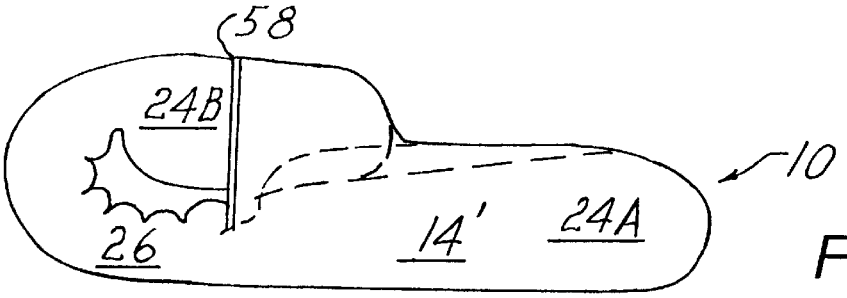
FIG. 13 is a side showing another alternative configuration of the apparatus of FIG. 1.

With further reference to FIG. 13, another and preferred means for maintaining the folded condition of the massaging pad 12 is to combine the cover 28 and the covering 14 as a covering 14' that includes a pocket portion 58, the enlargement 24B being inserted into the pocket portion 58.

Figure 14:
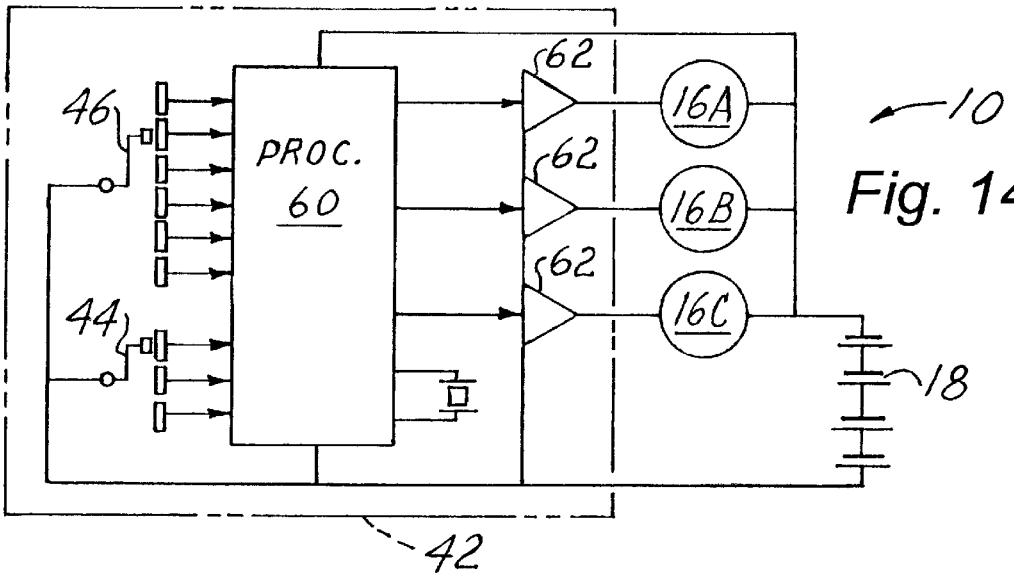
FIG. 14 is a circuit diagram of a transducer controller portion of the massaging apparatus of FIG. 1.

The intensity control 44 provides low, medium, and high power levels of operation for those of the vibratory transducers are activated by the mode control 46. The mode control 46 selectively activating the transducers 16A and 16B, the transducer 12C, or all of the transducers 16. The mode control 46 further provides intermittent control modes including alternately activating the transducers 16A and 16B, or sequentially activating all of the transducers 16 in an overlapping manner to produce a progressively advancing wave massaging effect simulative of "shiatsu" manual massaging that is performed by moving fingertips. With further reference to FIG. 14, an exemplary implementation of the controller 42 includes a conventional microprocessor controller 60 and respective drivers 62 for activating the vibratory transducers 16A, 16B, and 16C. The intensity control 44 and the mode control 46 are each connected to a plurality of inputs of the controller 60, the controller 60 being suitably programmed for periodically sensing respective positions of the controls 44 and 46 and correspondingly activating the drivers 62. Preferably, the drivers 62 are activated with respective digital signals having variable duty-cycles in response to the intensity control 44 for correspondingly activating the transducers 16 at corresponding power levers, without producing undesired power dissipation by the drivers 62.

The massaging apparatus 10 provides a particularly advantageous in massaging selected portions of a user 64. As shown in FIG. 2, the user 64 can rest with his shoulder portions 66 supported on the enlarged region 24A and his head/neck portion 68 supported in elevated relation to the shoulder portions 66, on the depression region 32 of the enlarged region 24B, the shoulder portions 66 also being comfortably supported on the depression region 36 of the enlarged region 24A. Alternatively, a larger portion of the user 64 is supportable on the flexible pad 12 in the flattened condition thereof. For example, the user 64 can rest his head/neck portion 68 on the upper profile portion 23B of the enlarged portion 24B, the profile portions 23A and 32C extending under the shoulder portions 66 and further under the user's torso 70 as shown in FIG. 4.

Although the present invention has been described in considerable detail with reference to certain preferred versions thereof, other versions are possible. For example, the transducers 16 can be powered by the power module 52 in place of the batteries 18, or the batteries 18 can be rechargeable from the power module 52. Also, the means for maintaining the massaging pad 12 in the folded condition can be a pair of hook-loop fasteners that are suitably affixed to facing portions of the enlarged regions 24A and 24B. Therefore, the spirit and scope of the appended claims should not necessarily be limited to the description of the preferred versions contained herein.

What is claimed is:

1. A massaging apparatus comprising:

(a) a flexible foam pad having a top profile, a bottom profile, and including spaced apart first and second enlarged regions and a more flexible region connecting the enlarged regions for permitting the pad to be deformed from a flattened condition wherein the regions are generally coplanar to a folded condition wherein the first enlarged region is substantially inverted and offset relative to the second enlarged region for forming a composite top profile in the folded condition, the composite top profile having a first raised portion being formed by the first enlarged region being supported on a portion of the more flexible region, a second, lower portion of the composite top profile being formed by a portion of the second enlarged portion;

(b) a plurality of vibrators coupled to the foam pad for vibrating the pad, at least one of the vibrators being within each of the enlarged regions; and (c) means for holding the pad in the folded condition.

2. The massaging apparatus of claim 1, wherein the means for holding the pad in the folded condition is a cover member.

3. The massaging apparatus of claim 2, wherein the cover member forms a covering of the flexible foam pad, the cover member having a pocket formed therein for selectively receiving the first enlarged region when the first enlarged region is folded against the second enlarged region.

4. The massaging apparatus of claim 2, further comprising a covering enclosing the flexible foam pad in the flattened and folded conditions thereof, the flexible foam pad together with the covering being insertable in the folded condition into the cover member for maintaining the folded condition, and being removable from the cover member for permitting the flattened condition.

5. The massaging apparatus of claim 1, wherein the means for holding the flexible pad in the folded condition is a belt member.

6. The massaging apparatus of claim 1, wherein the top profile has a depression formed therein within the second enlarged region of the flexible pad, a portion of the top profile of the first enlarged region extending at least partially into the depression in the folded condition of the flexible pad.

7. The massaging apparatus of claim 1, wherein the bottom profile has a head depression formed therein within the first enlarged region, the head depression facing away from the second enlarged region in the folded condition of the flexible pad, the apparatus being adapted for supporting a user's shoulder region on the second enlarged region while also supporting a head or neck region of the user on the first enlarged region and in elevated relation to the shoulder region.

8. The apparatus of claim 1, wherein a convex top profile portion of the first enlarged region is supported on the more flexible region at a level below the second enlarged portion, the first enlarged portion tapering toward an end extremity thereof onto a portion of the top profile portion of the second enlarged region for locating the raised portion of the composite top profile at an elevation being less than a combined thickness of the first and second enlarged portions.

9. The apparatus of claim 1, wherein the more flexible region has a ribbed configuration for enhanced flexibility without undesirably reduced thickness.

10. A massaging apparatus comprising:

(a) a flexible foam pad having a top profile, a bottom profile, and including a plurality of enlarged regions and a more flexible region connecting the enlarged regions for permitting the pad to be deformed from a flattened condition wherein the regions are generally coplanar to a folded condition wherein a first one of the enlarged regions is substantially inverted and offset relative to a second one of the enlarged regions, the top profile having a depression formed therein within the second enlarged region, a portion of the top profile of the first enlarged region extending at least partially into the depression of the second enlarged region in the folded condition, the bottom profile having a head depression formed therein within the first enlarged region, the head depression facing away from the second enlarged region in the folded condition of the flexible pad, the apparatus being adapted for supporting a user's shoulder region on the second enlarged region while also supporting a head or neck region of the user on the first enlarged region and in elevated relation to the shoulder region when the flexible pad is in the folded condition;

(b) a plurality of vibrators coupled to the foam pad for vibrating the pad, at least one of the vibrators being within each of the enlarged regions; and (c) a cover member for holding the pad in the folded condition, the cover member forming a covering of the flexible foam pad, the cover member having a pocket formed therein for selectively receiving the first enlarged region when the first enlarged region is folded against the second enlarged region.

* * * * *